US007467493B2

(12) United States Patent
Udriste et al.

(10) Patent No.: US 7,467,493 B2
(45) Date of Patent: Dec. 23, 2008

(54) RAISING DEVICE FOR RAISING A CLOSURE PANEL

(75) Inventors: Daniel Udriste, Weston, FL (US); Vasanth Suratkal, Bloomfield Hills, MI (US); Keith Gordon Robertson, Livonia, MI (US)

(73) Assignee: Keykert USA, Inc., Wixom, MI (US)

( * ) Notice: Subject to any disclaimer, the term of this patent is extended or adjusted under 35 U.S.C. 154(b) by 0 days.

(21) Appl. No.: 11/068,905

(22) Filed: Mar. 2, 2005

(65) Prior Publication Data

US 2005/0194791 A1 Sep. 8, 2005

Related U.S. Application Data

(60) Provisional application No. 60/549,821, filed on Mar. 4, 2004.

(51) Int. Cl.
*E05F 11/001* (2006.01)

(52) U.S. Cl. ..... 49/276

(58) Field of Classification Search ..... 49/263, 49/268, 272, 273, 274, 276, 277, 278, 394, 49/503

See application file for complete search history.

(56) References Cited

U.S. PATENT DOCUMENTS

| | | | | | |
|---|---|---|---|---|---|
| 3,157,224 | A * | 11/1964 | Spargur et al. | ..... | 160/189 |
| 4,844,567 | A * | 7/1989 | Chalabian | ..... | 312/139 |
| 5,020,838 | A | 6/1991 | Fukumoto | ..... | 292/201 |
| 5,299,386 | A * | 4/1994 | Naegelli et al. | ..... | 49/28 |
| 6,293,050 | B1 * | 9/2001 | Johnk | ..... | 49/276 |
| 6,871,381 | B1 * | 3/2005 | Luca | ..... | 16/52 |

* cited by examiner

*Primary Examiner*—Jerry Redman
(74) *Attorney, Agent, or Firm*—Aslan Baghdadi; Paul, Hastings, Janofsky & Walker LLP

(57) ABSTRACT

The invention relates to a raising device for raising or opening a closure panel, in particular a rear flip glass, decklid, door or hood of a vehicle, after the closure panel has been unlocked. The raising device includes a raising lever moveably supported by a base frame, a spring having one part coupled to the raising lever for providing a raising force and securing means associated with the base frame for securing another part of the spring to secure the spring in different spring conditions, where each spring condition yields a different spring force and raising the force.

15 Claims, 6 Drawing Sheets

RAISING DEVICE FOR RAISING A CLOSURE PANEL

CROSS-REFERENCE TO RELATED APPLICATION

This application claims the benefit of U.S. Provisional Patent Application Ser. No. 60/549,821 filed Mar. 4, 2004, which is herein incorporated by reference in its entirety.

BACKGROUND OF THE INVENTION

1. Field of the Invention

Embodiments of the present invention relate to a raising device for raising or opening a closure panel. More particularly, embodiments of the present invention relate to systems and methods for raising or opening a closure panel after the closure panel has been unlocked, where the closure panel can include but is not limited to a rear flip glass, decklid, door of a vehicle, or hood of a vehicle.

2. Background Information

In general a closure panel of a vehicle, like a rear flip glass, decklid, or hood, can be locked to the body of the vehicle by a raising locking device. This locking device may comprise a locking striker secured to one of the body and the closure panel and a catch with a hook part secured to the other of the body and the closure panel. For locking the closure panel, the catch can be moved to a first position at which the hook part is in hook engagement with the locking striker. For unlocking the closure panel the catch can be moved to a second position at which the hook part is in disengagement with the locking striker. The catch is retained in the first position by a pivoted pawl wherein a shoulder of the pawl is in engagement with a corresponding portion of the catch. The catch is coupled to a spring, which is preloaded when the catch is in its first position. For unlocking the closure panel the pawl rotates such that the retaining shoulder of the pawl disengages the catch allowing the catch to move in the second position, wherein with the help of the urging force of the spring the catch pushes the locking striker, thereby raising or opening the closure panel from the body (see e.g., U.S. Pat. No. 5,020,838). In the resulting clearance between closure panel and body, fingers of a user can grasp to open the closure panel completely.

The raising force of the spring that is required to raise or open the closure panel by a predetermined amount varies in particular with the weight of the closure panel. Therefore, a locking device with a spring providing a specific raising force has to be designed for each closure panel having a specific weight. This is time consuming and quite expensive.

In view of the foregoing, it can be appreciated that a substantial need exists for systems and methods that can advantageously raise or open a closure panel without regard to the weight of the closure panel.

BRIEF SUMMARY OF THE INVENTION

It is, therefore, an object of the present invention to provide a raising device, like a raising locking device or pop-up striker, which can easily be adapted to a closure panel with a particular weight and to a desired clearance eliminating the need to design different raising devices adapted to different weights of closure panels or different desired clearances.

The raising device for raising or opening a closure panel, in particular a rear flip glass, decklid, door or hood of a vehicle, after the closure panel has been unlocked, comprises, according to an embodiment of the invention, a raising lever movably supported by a base frame, a spring having one part coupled to the raising lever for providing a raising force, and securing means associated with the base frame for securing another part of the spring to secure the spring in different spring conditions wherein each spring condition yields a different spring force and a raising force.

The spring can be a pressure or tension spring wherein in various spring conditions the spring is expanded or compressed to different degrees.

Alternatively, the spring can be a torsion spring wherein in various spring conditions the spring is bent to different torsional degrees.

The raising lever is preferentially pivotably mounted to the base frame.

It is further preferred that the raising lever is mounted on a bar providing a pivot axis of the raising lever, wherein the spring is coiled around the bar and wherein leg portions of the spring are secured to the base frame by the securing means to secure the spring in one of the different spring conditions. Spaced securing elements providing securing means can be disposed in the base frame so that at least one leg portion of the spring can be secured to at least one of the securing elements providing one of the different spring conditions.

Spaced securing elements can be disposed in the base frame so that at least one end portion of the spring can be secured to at least one of the securing elements providing one of the different spring conditions.

The securing elements can comprise spaced L-shaped projections formed in the base frame wherein a leg portion of the spring can be hooked on one of the projections to secure the spring in one of the different spring conditions.

In a preferred embodiment, a stop is attached to the base frame to restrict movement of the raising lever. The spring can be preloaded so as to bias the raising lever against the stop.

The raising device can be a raising locking device or a pop-up striker, and the raising lever can be a catch means of the locking device.

Furthermore, the present invention provides a vehicle having a closure panel, like a rear flip glass, decklid, door or hood, pivoted to a body of the vehicle for closing and opening of the body comprising a raising device according to the present invention for raising or opening the closure panel, after it has been unlocked.

In a preferred embodiment, the vehicle comprises a raising locking device being the raising device and a catch means being the raising lever provided with a hook part, the raising locking device comprising a locking striker, the catch means being movable between a first position at which the hook part is an engagement with the locking striker and a second position at which the hook part is in disengagement with the locking striker and at which the catch means pushes the locking striker to raise the closure panel from the body, wherein the catch means is attached to one of the closure panel and the body and the locking striker is attached to the other of the closure panel and the body.

Figure 1:
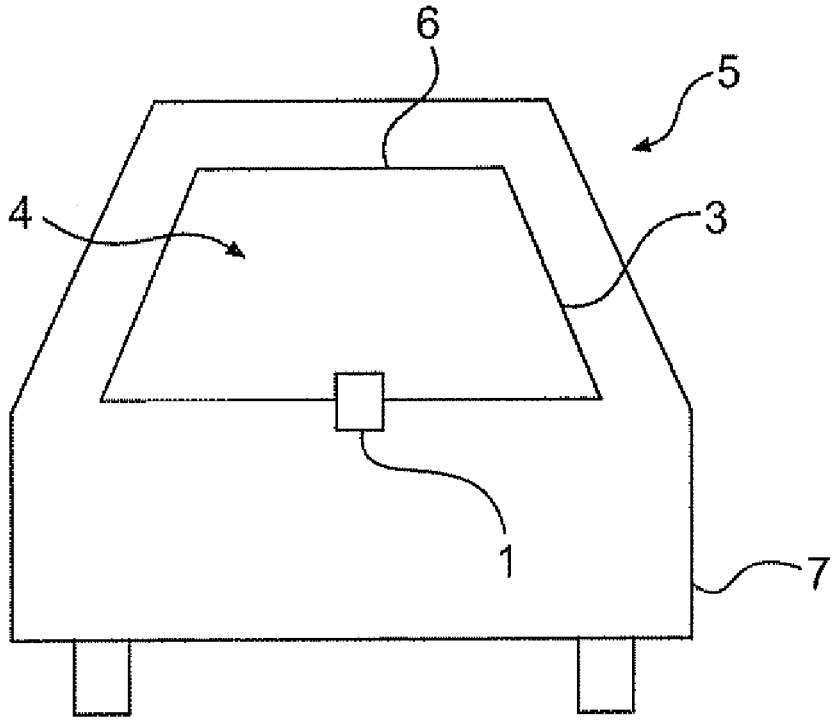
FIG. 1 is a schematic back view of a vehicle comprising a closure panel and a raising locking device, in accordance with an embodiment of the present invention.

Before one or more embodiments of the invention are described in detail, one skilled in the art will appreciate that the invention is not limited in its application to the details of construction, the arrangements of components, and the arrangement of steps set forth in the following detailed description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE INVENTION

FIG. 1 schematically shows a backside of a vehicle 5 with a rear flip glass 3 (closure panel), which closes an opening 4 of a body 7 of the vehicle 5. The rear flip glass 3 is pivoted to the body 7 at a pivot axis 6 such that the rear flip glass 3 can be opened in an upward direction to allow access e.g. to a vehicle cargo area. The vehicle 5 comprises a raising locking device 1 for locking the rear flip glass 3 to the body 7 and for raising the rear flip glass 3 from the body 7 after the rear flip glass 3 has been unlocked.

As an alternative to FIG. 1, the raising locking device 1 may lock a decklid, hood, or door of a vehicle to the body of the vehicle. Generally speaking, the raising locking device of this invention can be used to lock any closure panel to any kind of opening, where a clearance between the closure panel and an edge of the opening is required for opening the closure panel, e.g., where the closure panel does not have a handle.

Figure 2:
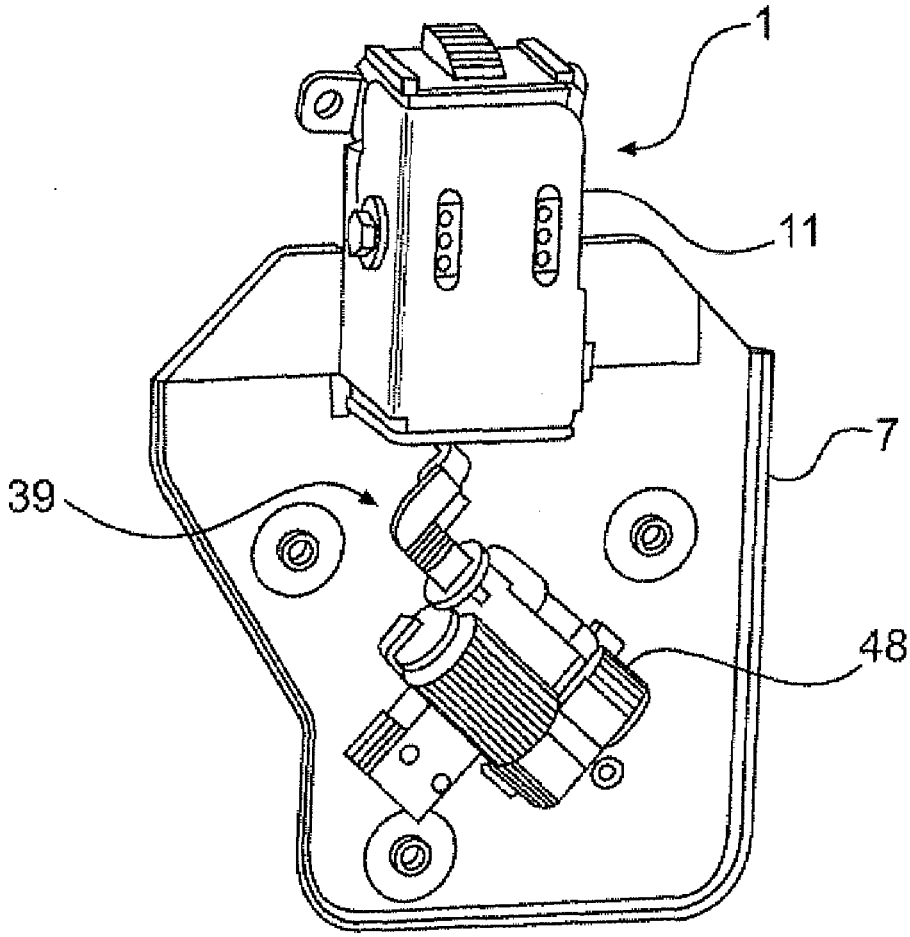
FIG. 2 is a perspective view showing an embodiment of the raising locking device of FIG. 1 attached to a body of the vehicle, in accordance wit an embodiment of the present invention.

The locking device 1 comprises a base frame 11 attached to the body 7 (see FIG. 2). The base frame 11 encloses a catch 9, a spring 13, and a pawl 39 (see FIG. 4). The locking device further comprises a hook-like or U-shaped locking striker 10, schematically shown in FIGS. 5 and 6, which is attached to the rear flip glass 3 (closure panel).

The catch 9 is pivoted to the base frame 11 by a pivot bar 17 with axis 19 wherein the catch 9 is disposed substantially in a center portion of a length of the bar 17 and wherein end portions 31, 33 of the bar 17 are rotatably supported by the base frame 11. In a first position, schematically shown in FIG. 5, a hook part 41 of the catch 9 engages the locking striker 10 thereby locking the rear flip glass 3 to the body 7. For unlocking the rear flip glass 3, the catch 9 is rotated in direction 43 towards a second position, schematically shown in FIG. 6, where the locking striker 10 is released from and in disengagement with hook part 41 of the catch 9 and wherein a pop-up portion 12 of the catch 9 pushes the locking striker 10, and thus the rear flip glass 3, in an upward or opening direction 45. Therefore, the catch 9 and in particular the pop-up portion 12 thereof forms the raising lever of the raising locking device 1.

The location of the catch 9 on the bar 17 defines two portions 35, 37 of the bar 17, a first portion 35 on one side and a second portion 37 on the other side of the catch 9, wherein the spring 13 is coiled around both portions 35, 37 and surrounds the catch 9 wherein a U-shaped center portion 25 of the spring 13 acts against a side face 26 of catch 9.

The base frame 11 comprises two substantially rectangular openings 80, 82. Each opening 80, 82 has two L-shaped projections 84, 86 or 88, 90, respectively, such that a bottom edge 92*a*, 92*d*, respectively, of each opening 80, 82 and an upper edge 92*b*, 92*c*, 92*e*, 92*f*, respectively, of each projection provide three pairs of support places 92*a*, 92*b*, 92*c* and 92*d*, 92*e*, 92*f*, respectively. Leg portions 21, 23 of the spring 13 are aligned substantially perpendicularly to the pivot axis 19 and are adapted to be engaged in any two of the support places 92*a*, 92*b*, 92*c* and 92*d*, 92*e*, 92*f* (securing means) of the base frame 11, i.e., each of the leg portions 21, 23 can be placed either on one of the bottom edges of the rectangles openings or on one of the upper edges of the projections.

Figure 4:
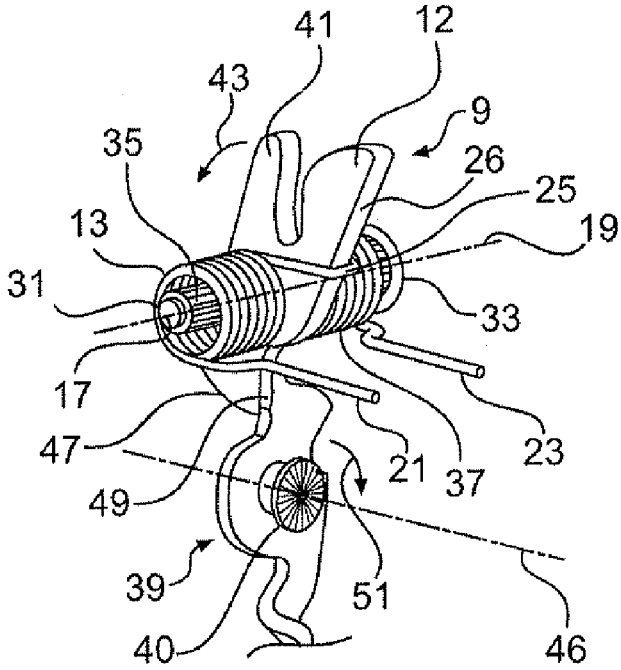
FIG. 4 is a perspective view showing a catch, pawl, and spring of the raising locking device of FIGS. 1, 2 and 3, in accordance with an embodiment of the present invention.
Figure 5:
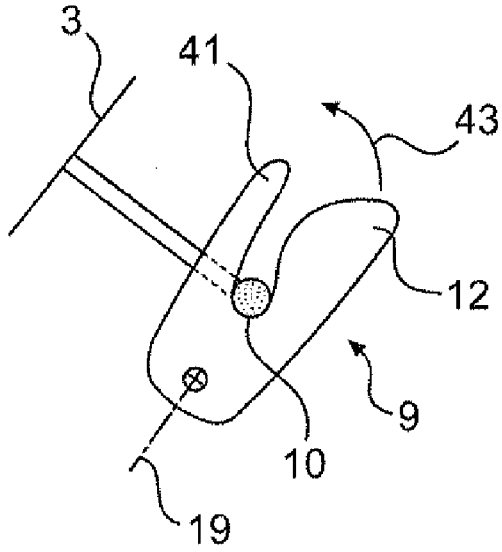
FIG. 5 is a schematic view showing the catch and a locking striker in a first, locked position, in accordance with an embodiment of the present invention.
Figure 6:
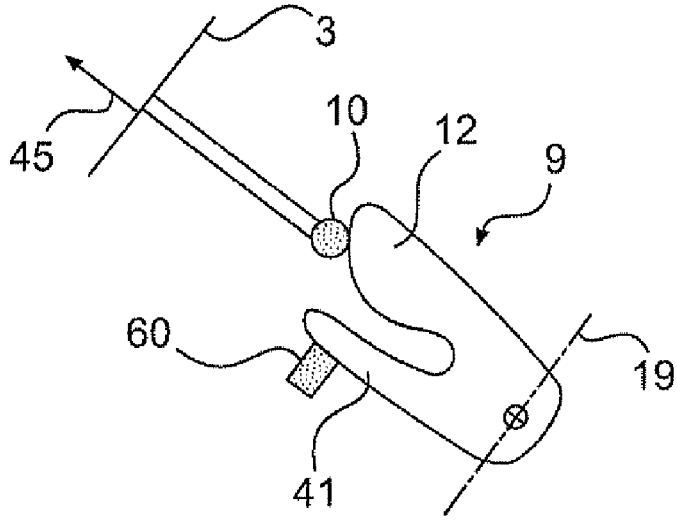
FIG. 6 is a schematic view showing the catch and the locking striker in a second, unlocked and raising position, in accordance with an embodiment of the present invention.

The pawl 39 holds the catch 9 in its first position locking the rear flip glass 3 to the body 7 (FIG. 5). The pawl 39 is rotatably supported at 40 around axis 46 and has a retaining portion 49, which is in engagement with a corresponding projection portion 47 of the catch 9 to hold the catch 9 in its first position (see FIGS. 4, 5). The pawl 39 is coupled with an actuator 48. When the actuator 48 rotates the pawl 39 in direction 51, the retaining portion 49 of the pawl 39 disengages from the projecting portion 47 of the catch 9. Since the catch 9 is being urged by the spring 13 to rotate in direction 43, the hook part 41 of the catch 9 will release the locking striker 10. Additionally, the pop-up portion 12 of the catch 9 is in contact with the locking striker 10 during the releasing rotating motion of the catch 9, thereby transferring a raising force of the spring 13 to the rear flip glass 3 which results in a raising movement of the rear flip glass 3 relative to the body 7 and provides a corresponding clearance.

Figure 3:
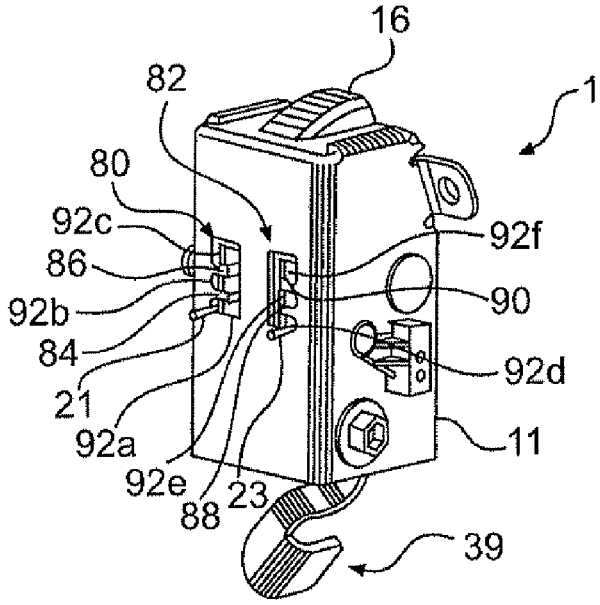
FIG. 3 is a perspective view showing a base frame of the raising locking device of FIGS. 1 and 2 enclosing a catch and a pawl of the raising locking device, in accordance with an embodiment of the present invention.

The width of the clearance generally depends on the relation between the spring force of the spring 13 and the weight of the rear flip glass 3. The spring force can easily be varied by placing the leg portions 21, 23 of the spring 13 at different support places 92*a* . . . 92*f* of the base frame 11. As is shown in FIG. 3 each one of the leg portion 21, 23 can be placed at one of a plurality of support places, wherein three support places 92*a*, 92*b*, 92*c* and 92*d*, 92*e*, 92*f*, respectively, are illustrated. In this embodiment the spring force is minimal when the leg portions 21, 23 are placed at support places 92*a*, 92*d* as shown in FIG. 3, and the spring force is maximal when the end portions 21, 23 are placed at support places 92*c*, 92*f*. For a particular weight of a rear flip glass 3 a desired clearance can be achieved without substituting the spring 13 just by placing the leg portions 21, 23 of the spring at properly chosen support places 92*a* . . . 92*f*. Furthermore, for different rear flip glasses which require different raising forces, e.g. because they have different weights, the same raising locking devices with one and the same spring can be used wherein the raising locking devices can simply be adapted to the respective rear flip glasses by placing the leg portions 21, 23 of the spring 13 at proper support places. Thus, with the present invention it is not necessary to design an individual raising locking device for each individual rear flip glass.

The actuator 48 can be driven electrically, pneumatically, or mechanically. In a preferred embodiment, the actuator 48 is remote-controlled.

With the securing means 92*a* . . . 92*f* in FIG. 3 the spring 3 can be secured in three different spring conditions yielding three different spring forces and thus three different raising forces. Alternatively, less or more than six support places can be used providing less or more possible spring conditions and thus less or more different raising forces. Additionally, instead of support places, i.e. L-shaped projections or edges of openings, other securing means can serve as securing means, e.g. snapping or screwing means or the like, in order to secure the leg portions 21, 23 of the spring 13 to the base frame 11 at proper positions, and thus the spring 13 in proper spring conditions.

The base frame 11 has a substantially rectangular shape and forms a casing for enclosing catch 9, pawl 39, and spring 13. The base frame 11 of the raising locking device 1 according to FIGS. 2 to 4 comprises an elevated portion 16 adjacent to and surrounding the catch 9.

The raising device can be attached to the body of the vehicle or to the closure panel. That is, the base frame containing catch, spring and pawl and the actuator of the raising locking device can be attached to one of the body and the closure panel, and the locking striker can be attached to the other of the body and the closure panel.

The spring according to FIGS. 1 to 4 is a torsion spring, i.e. a spring which is preloaded by torsion. In other embodiments, a pressure or tension spring can be used to provide the raising force. In such an embodiment, one end of the spring can be attached to the catch and the other end of the spring can be attached to one of several different attaching points within a base frame. In each of these attaching points, the spring is more or less expanded or compressed which yields different spring forces, and therefore different raising forces, of the spring. Thus, the said attaching points provide securing means.

A spring condition is defined by the degree of expansion, compression or bending (torsion angle) of the spring. In the embodiment illustrated in FIGS. 1 to 6, the degree of bending (torsion angle) and the spring force are largest, when the leg portions 21, 23 are situated at the support places 92*c*, 92*f* and the degree of bending and the spring force are smallest, when the leg portions 21, 23 are placed at the support places 92*a*, 92*d*.

Figure 7:
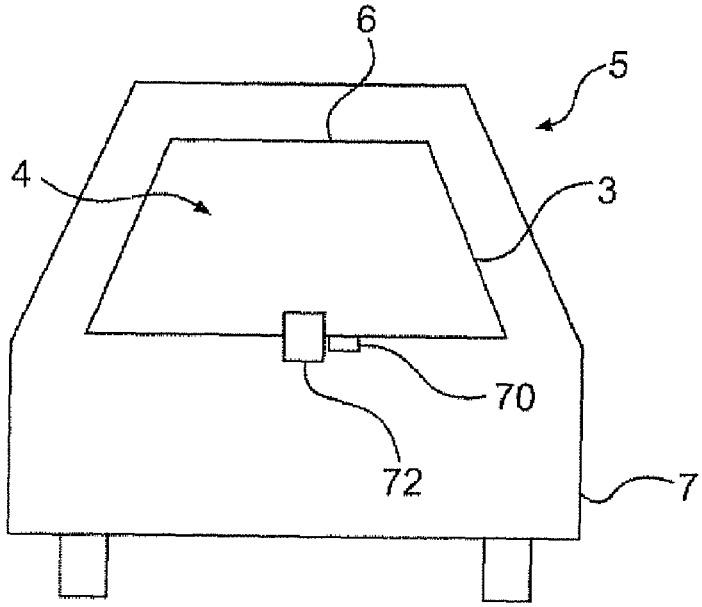
FIG. 7 is a schematic back view of a vehicle comprising a closure panel, a conventional locking device, and a pop-up striker, in accordance with an embodiment of the present invention.

In the above-described embodiment, the raising locking device locks and unlocks the closure panel and provides a pop-up movement relative to the body of the vehicle. Alternatively, as illustrated in FIG. 7, the locking device can be a conventional locking device 72 which only serves for locking the closure panel 3 to the body 7, wherein the raising force would be generated by a separate raising device. This separate raising device can be a pop-up striker 70.

Figure 8:
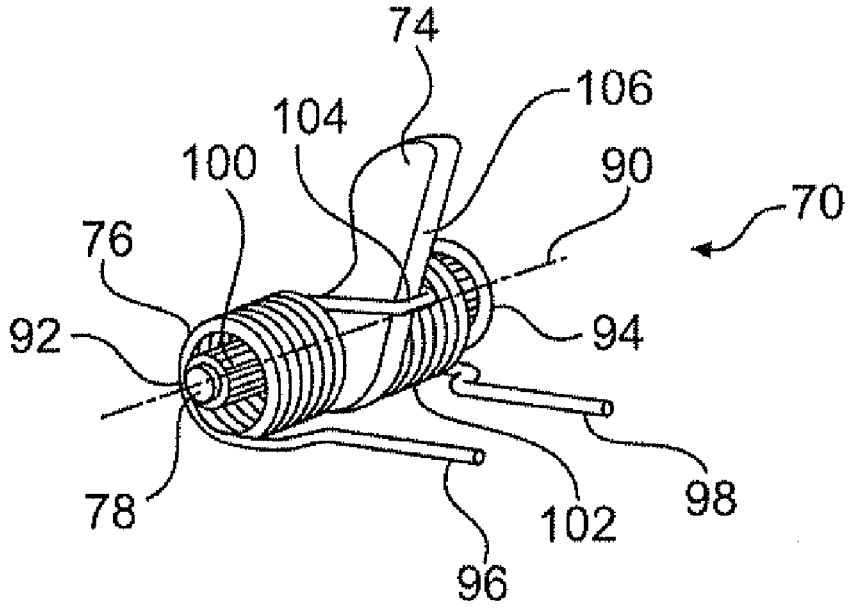
FIG. 8 is a perspective view showing the pop-up striker of FIG. 7, in accordance with an embodiment of the present invention.

The pop-up striker 70 (see FIG. 8) uses a torsion spring 76 similar to the spring 13 shown in FIG. 4. A raising lever 74 is arranged like the catch 9 in FIG. 4. Thus, the raising lever 74 is pivoted to a base frame by a pivot bar 78 with axis 90 wherein the raising lever 74 is disposed substantially in a center portion of a length of the bar 78 and wherein end portions 92, 94 are rotatably supported by the base frame. The location of the raising lever 74 on the bar 92 defines two portions 100, 102 of the bar 78, a first portion 100 on one side and a second portion 102 on the other side of the raising lever 74, wherein the torsion spring 76 is coiled around both portions 100, 102 and surrounds the raising lever 74. A U-shaped center portion 104 of the torsion spring 76 acts against a side face 106 of the raising lever 74. Leg portions 96, 98 of the spring 76 can be attached to different securing places in the base frame yielding different spring conditions and raising forces. As explained above in connection with FIGS. 2-4, the leg portions of the spring could be placed at different support places 92*a* . . . 92*f* in the base frame to achieve different spring conditions. By selecting proper securing places for the leg portions of the spring the spring condition and thus the raising force of the pop-up striker can be adapted to a particular closure panel weight.

A pop-up striker can be attached to a closure panel of a vehicle. Alternatively, it could be attached to the body of the vehicle. The spring is preloaded so as to bias the raising lever against a corresponding portion of the body when the closure panel is locked. When the closure panel is unlocked by the locking device, the raising lever pushes against a corresponding portion of the body or closure panel and raises the closure panel from the body.

In another embodiment, the pop-up striker comprises a raising lever pivoted to a base frame and coupled to a tension or pressure spring. One end of the spring is attached to the raising lever and the other end of the spring is secured to one of different possible securing places within a base frame by securing means for holding the spring in a desired spring condition. Depending on the securing place chosen, the spring is set in a differently expanded or compressed condition in a closed condition of the closure panel leading to different spring conditions and spring forces of the spring, thereby providing different raising forces, when the closure panel is unlocked. By attaching the other end of the spring to one of different securing places the spring condition and thus the raising force of the pop-up striker can be adapted e.g. to a particular closure panel weight.

The raising device, i.e., the pop-up striker 70 or the raising locking device 1, can comprise a stop 60 (FIG. 5) secured to the base frame to restrict a pivoting movement of the raising lever (catch 9). The stop can be U-shaped and both ends of the stop can be attached to the base frame. The stop is arranged on the base frame such that the raising lever hits the stop when the desired clearance between the closure panel and the body has been reached. The spring can be preloaded so as to bias the raising lever against the stop.

If the spring force of the spring is too large, the clearance between the closure panel and the body might be large enough, but in use, it can be difficult to close and lock the closure panel easily. On the other hand, if the spring force is too small, the closure panel can easily be closed and locked, but the clearance achieved between the closure panel and the body can be too small, when the closure panel is unlocked. To overcome this problem, heretofore for each particular closure panel with a particular weight a raising device, i.e., raising locking device or pop-up striker, with a spring providing a particularly determined spring force had to be designed. In contrast, the raising device according to the invention can easily be adapted to the weight of a particular closure panel by securing the spring by the securing means in a properly chosen spring condition providing the required raising force. Thus, the raising device according to the invention can be used with closure panels having different weights eliminating the need of substituting the spring.

With continuing reference to the figures, the following examples illustrate embodiments of the present invention.

A first exemplary embodiment provides a raising device for raising or opening a closure panel 3, in particular a rear flip glass 3, decklid, door or hood of a vehicle 5, after the closure panel has been unlocked, the raising device comprising: a raising lever 9, 12 moveably supported by a base frame 11; a spring 13 having one part 25 coupled to the raising lever 9 for providing a raising force; and securing means 92*a* . . . 92*f* associated with the base frame 11 for securing another part 21, 23 of the spring 13 to secure the spring 13 in different spring conditions, wherein each spring condition yields a different spring force and raising force.

In a further aspect of the first exemplary embodiment, the spring is a pressure or tension spring and, in various spring conditions, the spring is expanded or compressed to different degrees.

In a further aspect of the first exemplary embodiment, the spring is a torsion spring and, in various spring conditions, the spring is bent to different torsional degrees.

In a further aspect of the first exemplary embodiment, the raising lever 9 is pivotably mounted to the base frame 11. In a further example of this aspect of the first exemplary embodiment, the raising lever 9 is mounted on a bar 17, providing a pivot axis 19 of the raising lever 9, wherein the spring 13 is coiled around the bar 17 and wherein leg portions 21, 23 of the spring 13 are secured to the base frame 11 by the securing means 92*a* . . . 92*f* to secure the spring 13 in one of the different spring conditions.

In a further aspect of the first exemplary embodiment, spaced securing elements 92*a* . . . 92*f* are disposed in the base frame 11 so that at least one end portion 21, 23 of the spring 13 can be secured to at least one of the securing elements 92*a* . . . 92*f* providing one of the different spring conditions. In a further example of this aspect of the first exemplary embodiment, the securing elements comprise spaced L-shaped projections 84, 86, 88, 90 formed in the base frame 11, wherein a leg portion 21, 23 of the spring 13 can be hooked on one of the projections 84, 86, 88, 90 to secure the spring 3 in one of the different spring conditions.

In a further aspect of the first exemplary embodiment, the raising device further comprises a stop 60 attached to the base frame 11 to restrict movement of the raising lever 9. In a further example of this aspect of the first exemplary embodiment, the spring 13 is preloaded so as to bias the raising lever 9 against the stop 60.

In a further aspect of the first exemplary embodiment, the raising device is a raising locking device 1 or a pop-up striker 70.

In a further aspect of the first exemplary embodiment, the raising lever 9 is a catch means 9 of a locking device 1.

A second exemplary embodiment of the present invention provides a vehicle 5 having a closure panel 3, like a rear flip glass 3, decklid, door or hood, pivoted to a body 7 of the vehicle 5 for closing an opening 4 of the body 7, the vehicle comprising a raising device 1 for raising or opening a closure panel 3, in particular a rear flip glass 3, decklid, door or hood of a vehicle 5, after the closure panel has been unlocked, the raising device comprising: a raising lever 9, 12 moveably supported by a base frame 11; a spring 13 having one part 25 coupled to the raising lever 9 for providing a raising force; and securing means 92*a* . . . 92*f* associated with the base frame 11 for securing another part 21, 23 of the spring 13 to secure the spring 13 in different spring conditions, wherein each spring condition yields a different spring force and raising force.

In a further aspect of the second exemplary embodiment, the raising device 1 is a raising locking device 1 and the raising lever 9 is a catch means 9 provided with a hook part 41, the raising locking device 1 comprising a locking striker 10, the catch means 9 being movable between a first position at which the hook part 41 is in engagement with the locking striker 10 and a second position at which the hook part 41 is in disengagement with the locking striker 10 and at which the catch means 9 pushes the locking striker 10 to raise the closure panel 3 from the body 7, wherein the catch means 9 is attached to one of the closure panel 3 and the body 7 and the locking striker 10 is attached to the other of the closure panel 3 and the body 7.

List of reference numerals

| | |
|---|---|
| 1 | raising locking device |
| 3 | rear flip glass |
| 5 | vehicle |
| 7 | body |
| 9 | catch |
| 10 | locking striker |
| 11 | base frame |
| 12 | pop-up portion of the catch |
| 13 | spring of the raising locking device |
| 16 | elevated portion of the base frame |
| 17 | pivot bar of the catch |
| 19 | pivot axis of the catch |
| 21, 23 | leg portions of the spring |
| 25 | U-shaped center portion of the spring of the raising locking device |
| 26 | side face of the catch |
| 31, 33 | end portions of the pivot bar of the catch |
| 35, 37 | portions of the pivot bar of the catch |
| 39 | pawl |
| 40 | support position |
| 41 | hook part of the catch |
| 43 | rotational direction of the catch |
| 45 | upward or opening direction of the rear flip glass |
| 46 | pivot axis of the pawl |
| 47 | projection portion of the catch |
| 48 | actuator |
| 49 | retaining portion of the pawl |
| 51 | rotational direction of the pawl |
| 60 | stop |
| 70 | pop-up striker |
| 72 | conventional locking device |
| 74 | raising lever |
| 76 | spring of the pop-up striker |
| 78 | pivot bar of the raising lever of the pop-up striker |
| 80, 82 | rectangular openings of the base frame |
| 84, 86, 88, 90 | L-shaped projections |
| 90 | pivot axis of the raising lever of the pop-up striker |
| 92a . . . 92f | support places (securing means) |
| 92, 94 | end portions of the pivot bar of the raising lever of the pop-up striker |
| 96, 98 | leg portions of the spring of the pop-up striker |
| 100, 102 | portions of the pivot bar of the pop-up striker |
| 104 | U-shaped center portion of the spring of the pop-up striker |
| 106 | side face of the raising lever of the pop-up striker |

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A raising device and closure panel combination for raising or opening the closure panel comprising:

a raising lever moveably supported by a base frame;

a spring having one part coupled to the raising lever for providing a raising force; and securing means associated with the base frame for securing another part of the spring to secure the spring in different conditions, wherein each spring condition yields a different spring force and raising force, and wherein the raising lever is configured to engage a portion of the closure panel and to move the engaged portion of the closure panel in a direction away from the raising lever during said raising or opening.

2. The combination of claim 1, wherein the spring is a torsion spring.

3. The combination of claim 1, wherein the securing means comprises one or more notches or projections formed in the base frame, and the spring comprises one or more legs that engage with the one or more notches or projections.

4. The combination of claim 1, wherein the closure panel comprises a locking striker secured to a lid, the raising lever configured to engage the locking striker.

5. The raising device of claim 1, further comprising a pawl configured to lock the raising lever when the pawl is in a first position and to release the raising lever when the pawl is in a second position.

6. The combination of claim 5, wherein the raising lever urges the portion of the closure panel out of engagement with the raising lever upon the pawl being moved to the second position.

7. The combination of claim 1, wherein the raising lever is generally U-shaped.

8. The combination of claim 1, wherein the spring comprises one or more legs, extending tangentially outward from a spring coil, that are selectively securable in a plurality of positions by the securing means.

9. The combination of claim 1, wherein the spring comprises a U-shaped portion for coupling to the raising lever.

10. The combination of claim 1, wherein the raising lever comprises an arcuate surface configured to move a portion of the closure panel out of engagement with the raising lever during said raising or opening.

11. The combination of claim 1, wherein the base frame comprises a stop member configured to limit movement of the raising lever.

12. The combination of claim 1, wherein the raising lever is configured to move the portion of the closure panel out of engagement with the raising lever.

13. A raising device and closure panel combination for raising or opening the closure panel, comprising:

a catch pivotally attached to a support bar, the catch having a hook portion and a raising portion;

a torsion spring having a first portion coupled to the catch and a second portion coupled to a base frame, the second portion being securable in any one of a plurality of positions, each of the plurality of positions yielding a different spring force in the spring, wherein the hook portion is configured to retain the closure panel by engaging a portion of the closure panel and the raising portion is configured to move the portion of the closure panel in a direction away from the catch during said raising or opening, the spring providing a force to pivot the catch to transfer engagement with the portion of closure panel from the hook portion to the raising portion.

14. The combination of claim 13, further comprising a pawl configured to lock and subsequently release the catch, the spring providing the force to the catch upon the catch being released by the pawl.

15. The combination of claim 13, wherein the support bar extends through coils of the spring.

* * * * *